US008387576B2

(12) United States Patent
Iwata

(10) Patent No.: US 8,387,576 B2
(45) Date of Patent: Mar. 5, 2013

(54) ENGINE

(75) Inventor: Yasushi Iwata, Toyota (JP)

(73) Assignee: Toyota Jidosha Kabushiki Kaisha, Aichi-ken (JP)

( * ) Notice: Subject to any disclaimer, the term of this patent is extended or adjusted under 35 U.S.C. 154(b) by 315 days.

(21) Appl. No.: 12/669,674

(22) PCT Filed: Jul. 18, 2008

(86) PCT No.: PCT/IB2008/001880

§ 371 (c)(1),
(2), (4) Date: Mar. 2, 2010

(87) PCT Pub. No.: WO2009/013588

PCT Pub. Date: Jan. 29, 2009

(65) Prior Publication Data

US 2010/0192887 A1 Aug. 5, 2010

(30) Foreign Application Priority Data

Jul. 20, 2007 (JP) ..... 2007 189664

(51) Int. Cl.
*F01L 1/34* (2006.01)

(52) U.S. Cl. ..... 123/90.17; 123/90.31

(58) Field of Classification Search ..... 123/90.15, 123/90.17, 90.31
See application file for complete search history.

(56) References Cited

U.S. PATENT DOCUMENTS

| | | | | |
|---|---|---|---|---|
| 4,199,202 | A | 4/1980 | Maeda | |
| 2003/0101949 | A1 * | 6/2003 | Uchida | 123/90.12 |
| 2005/0120992 | A1 * | 6/2005 | Rieger et al. | 123/193.5 |

FOREIGN PATENT DOCUMENTS

| | | | |
|---|---|---|---|
| JP | 4-94404 | A | 3/1992 |
| JP | 5-86913 | A | 4/1993 |
| JP | 2000-73903 | A | 3/2000 |
| JP | 2000-328909 | A | 11/2000 |
| JP | 2001-12225 | A | 1/2001 |
| JP | 2001-65373 | A | 3/2001 |
| JP | 2003-269243 | A | 9/2003 |
| JP | 2004-124773 | A | 4/2004 |
| JP | 2005-98169 | A | 4/2005 |
| JP | 2006-328987 | A | 12/2006 |

* cited by examiner

*Primary Examiner* — Zelalem Eshete
(74) *Attorney, Agent, or Firm* — Sughrue Mion, PLLC

(57) ABSTRACT

An oil recovery part (20A, 20B) for guiding oil to an inner side of a peripheral wall of a cylinder head (2) is provided at a front wall upper end of the cylinder head (2), the oil leaking from a concave bearing (3*a*, 3*b*) that supports a camshaft (8, 9) provided at a forefront end of a cam housing (3).

9 Claims, 12 Drawing Sheets

ENGINE

FIELD OF THE INVENTION

This invention relates to an engine (also called internal combustion engine) in which a camshaft is supported rotatably by a cam housing attached onto a cylinder head, and more particularly to an improved structure for oil to flow from a supporting part of a journal part positioned at a forefront end of the camshaft.

BACKGROUND OF THE INVENTION

Japanese Patent Application Publication No. 5-86913 (JP-A-5-86913) discloses an engine mounted with a hydraulically-driven variable valve timing mechanism for changing valve timing.

This variable valve timing mechanism is a mechanism capable of changing the timing of opening and closing at least one of intake and exhaust valves by advancing or retarding a rotational phase of at least one of intake and exhaust camshafts in relation to a rotational phase of a crankshaft.

The abovementioned hydraulically-driven variable valve timing mechanism has a controller that is constituted by a vane actuator installed on the front end side of the camshafts, and an oil control valve for adjusting the pressure of working oil supplied to an advance-side pressure chamber and a retard-side pressure chamber of the controller.

This engine might be provided with a supply passage for pumping up oil of an oil pan (oil storage) provided on a bottom part of the engine by using an oil pump and then supplying the oil to two systems of a cylinder block system and a cylinder head system. Note that the oil that lubricates the inside of the cylinder block and the inside of the cylinder head is returned to the oil pan, and thus the oil circulates in a closed loop within the engine.

The oil that is supplied to the cylinder block system is also supplied to a crank journal, oil jet, and the like. The oil that is supplied to the cylinder head system, on the other hand, is supplied in the form of working oil to the oil control valve of the variable valve timing mechanism described above.

Note that the oil that is supplied to the cylinder head system is supplied to a journal part positioned at a forefront end of a camshaft and to the oil control valve and each pressure chamber of the controller of the variable valve timing mechanism via oil passages provided within a forefront-end cam cap attached to a concave bearing of a cam housing that supports the forefront-end journal part. Note that the oil that returns from each pressure chamber of the controller is discharged into the cam housing through the oil passages.

As in the related art described above, in a case where part of the oil passages for supplying and recovering the oil to and from the controller and oil control valve of the variable valve timing mechanism is provided in the cam cap and camshaft attached to the forefront-end concave bearing of the cam housing, there is a possibility that the oil flowing through the oil passages leaks from a sliding contact surface where the forefront-end concave bearing of the cam housing and the cam cap come into sliding contact with the journal part positioned at the forefront end of the camshaft, into a timing chain cover.

This sliding contact surface is a part where the concave bearing and cam cap come into sliding contact with the camshaft, and thus needs a gap of appropriate thickness therebetween. For this reason, the oil leakage occurs easily.

Therefore, when the oil that leaks into the timing chain cover contacts with the timing chain, there is a risk of friction loss that is caused by rotation resistance of a timing chain. Especially when the oil leaking from the sliding contact surface into the timing chain in spite of the system that lubricates the timing chain using the oil, excessive amount of oil is supplied to the timing chain, resulting in unexpected grow of friction loss.

Since it is desired to alleviate the friction loss as much as possible in view of improving engine efficiency and fuel consumption performance, there is room for improvement.

Note that even in an engine that is not mounted with the above variable valve timing mechanism, oil leaks from a sliding contact surface where a forefront-end journal part of the camshaft comes into sliding contact with the concave bearing of the cam housing and with the cam cap.

SUMMARY OF THE INVENTION

This invention provides an engine in which a camshaft is rotatably supported by a cam housing mounted on a cylinder head, wherein oil that leaks from a supporting part provided at a forefront end of the camshaft is caused not to contact with a timing chain so that unexpected grow of friction loss can be inhibited or prevented.

A first aspect of this invention relates to an engine in which a camshaft is rotatably supported by a cam housing mounted on a cylinder head. This engine has: the cylinder head; a cam housing mounted on the cylinder head; a camshaft supported rotatably by the cam housing; a forefront-end concave bearing which is provided at a front wall upper end of the cylinder head and which supports the camshaft supported by the cam housing; and an oil recovery part for guiding oil leaking from the concave bearing to an inner side of a peripheral wall of the cylinder head.

According to this constitution, even if the oil leaks from the concave bearing that supports the camshaft provided at a forefront end of the cam housing, this leaking oil can be guided from the oil recovery part to the inner side of the peripheral wall of the cylinder head. Therefore, the phenomenon in which excessive amount of oil is supplied to the timing chain as in the related art can be avoided. Consequently, unexpected grow of friction loss that occurs in the related art can be inhibited or prevented.

The oil recovery part may have a projecting part that is provided in a region corresponding to the concave bearing at the front wall upper end of the cylinder head, and a groove that is provided in the projecting part and receives and guides the leaking oil to the inner side of the peripheral wall of the cylinder head.

Specifying the constitution of the oil recovery part in this manner makes it easier to understand the pattern of recovering the leaking oil.

The oil recovery part may have, at a front end thereof, a rising wall that extends upward.

This engine may further have a tapered slope that is provided at a front end lower corner of the forefront-end concave bearing of the cam housing.

The inclination of the tapered slope may be formed such that a rear end thereof is positioned lower than a front end thereof.

According to this constitution, a front opening of the groove is enlarged by the presence of the slope, whereby the leaking oil can be received easily and recovery operation is improved.

The oil recovery part may be provided below the concave bearing such that the front end of the oil recovery part is positioned forward of the forefront end of the concave bearing and a rear end of the oil recovery part is positioned on the inner side of the peripheral wall of the cylinder head.

A second aspect of this invention relates to an engine. This engine has: a cylinder head; a cam housing mounted on the cylinder head; an intake camshaft and exhaust camshaft that are supported rotatably by the cam housing; a hydraulically-driven variable valve timing mechanism which has a controller constituted by a vane actuator installed at a front end of at least one of the intake camshaft and the exhaust camshaft, and an oil control valve for adjusting supply/recovery of working oil with respect to the controller, and which is capable of changing a timing of opening and closing at least one of an intake valve and an exhaust valve by advancing or retarding a rotational phase of at least one of the intake camshaft and exhaust camshaft in relation to a rotational phase of a crankshaft; a forefront-end side journal part of the camshaft, which is provided with a part of an oil passage connecting the controller to the oil control valve; a concave bearing which is provided at a front wall upper end of the cylinder head and which supports the camshaft provided at a forefront end of the cam housing; and an oil recovery part that guides, to an inner side of a peripheral wall of the cylinder head, oil leaking from a sliding contact surface between the forefront-end side journal part of the camshaft and the concave bearing.

In this constitution provided with the variable valve timing mechanism as described above, oil hardly leaks from the concave bearing that supports the camshaft provided at the forefront end of the cam housing.

Specifically, when a part of the oil passage or supplying and recovering the oil to and from the controller and oil control valve of the variable valve timing mechanism is provided in a cam cap or the camshaft attached to the forefront-end concave bearing of the cam housing, there is a risk that the oil flowing through the oil passage leaks from a sliding contact surface where the concave bearing positioned at the forefront end of the cam housing comes into sliding contact with the journal part position at the forefront end of the camshaft, into a timing chain cover.

However, even when such oil leakage occurs, the above constitution enables guiding of the leaking oil to the inner side of the peripheral wall of the cylinder head through the oil recovery part. Consequently, the phenomenon in which excessive amount of oil is supplied to the timing chain as in the related art can be avoided. As a result, unexpected grow of friction loss that occurs in the related art can be inhibited or prevented.

The engine further has: a conveyance passage for supplying the oil, which is pumped up from an oil pan by an oil pump, to the oil control valve; and an advance-side oil passage and a retard-side oil passage for exchanging the oil between the oil control valve and advance-side and retard-side pressure chambers of the controller. The advance-side oil passage and the retard-side oil passage may be each configured by at least combining a first part that is provided over an area between the oil control valve and an outer peripheral surface of the forefront-end journal part of the camshaft, and a second part that is connected from the first part to each of the pressure chambers through the inside of the camshaft.

According to this constitution, the oil flowing through the advance-side oil passage and the retard-side oil passage might leak from the concave bearing that supports the camshaft provided at the forefront end of the cam housing. Specifically, the above description specifies one example of the constitution where oil leakage might occur. However, the oil that might leak is guided to the inner side of the peripheral wall of the cylinder head as described above, and is inhibited or prevented from falling onto an external side of the peripheral wall, that is, an internal space of the timing chain cover.

According to this invention, even when the oil leaks from the supporting part provided at the forefront end of the camshaft, this oil can be caused not to contact with the timing chain. Therefore, unexpected grow of friction loss that occurs in the related art can be inhibited or prevented.

BRIEF DESCRIPTION OF THE DRAWINGS

The foregoing and further features and advantages of the invention will become apparent from the following description of example embodiments with reference to the accompanying drawings, wherein like numerals are used to represent like elements and wherein.

DETAILED DESCRIPTION OF EMBODIMENTS

The best embodiments of the invention are described hereinafter in detail with reference to FIGS. 1 to 12. First, a first embodiment of the invention is shown in FIGS. 1 to 9.

An overview of an engine used on the first embodiment is described with reference to FIGS. 4 to 6.

Figure 4:
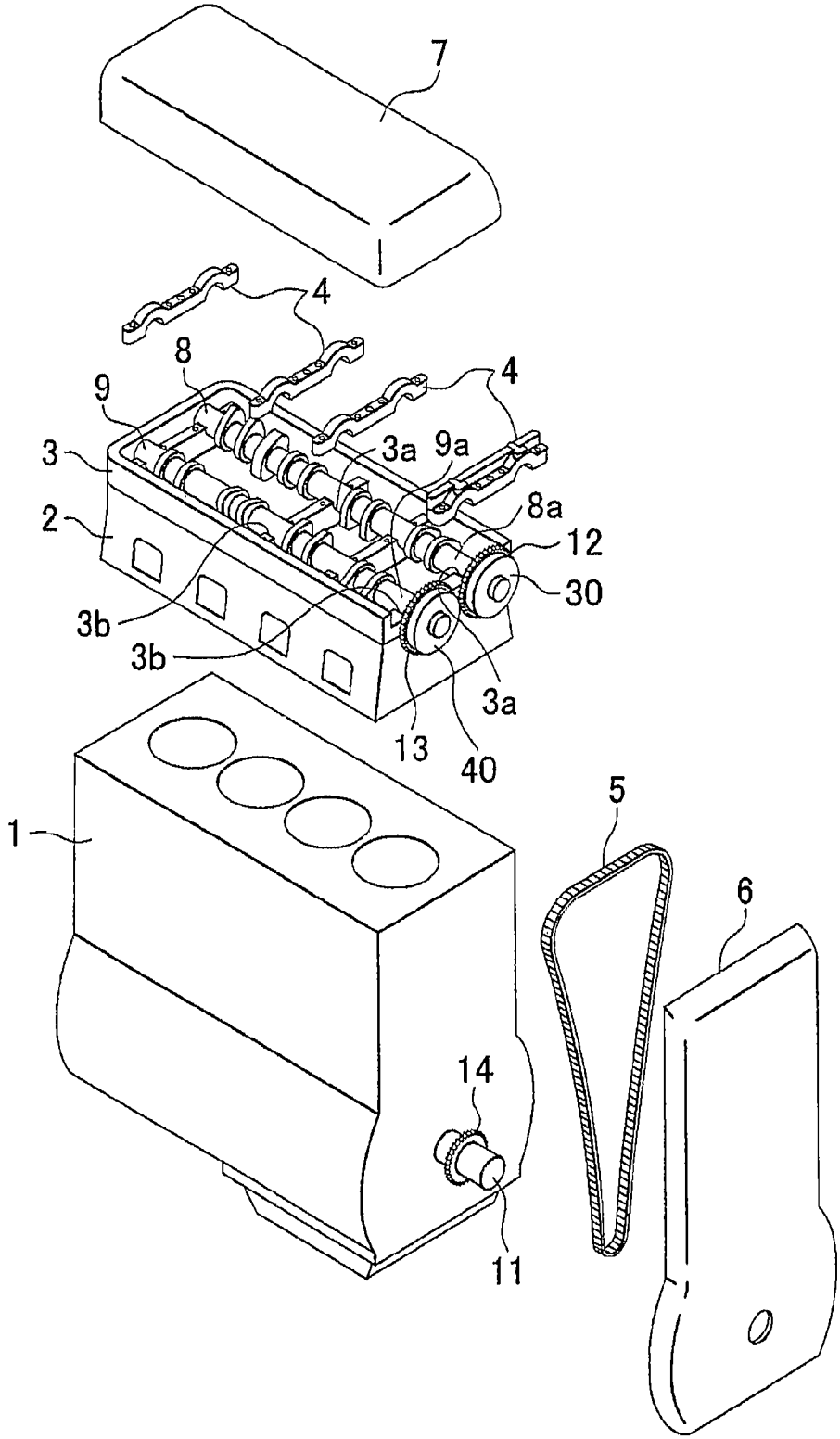
FIG. 4 is an exploded perspective view of a part of the engine used in each embodiment of the invention.

FIG. 4 is an exploded perspective view showing a part of the engine common to the embodiments of the invention. FIG. 5 is a side view showing a fractured front end side of the engine of FIG. 4. FIG. 6 is a front view showing a state in which a timing chain cover is removed from the engine shown in FIG. 5.

In the engine of this specification, the side in which a timing chain (or a timing belt) is disposed represents the front of the engine in order to clarify the meanings of "front end" and "rear end."

Note that the basic configuration or principle of operation of the engine is a conventional matter, the parts related to the characteristics of the first embodiment are described in detail, and thus the detailed description of the parts that are not related directly to the characteristics of the first embodiment is omitted.

The engine shown in the drawings is, for example, a four-cylinder DOHC gasoline engine. In each drawing, reference numeral 1 represents a cylinder block, 2 a cylinder head, 3 a cam housing, 4 a cam cap, 5 a timing chain (or a timing belt), 6 a timing chain cover (or a timing belt cover), and 7 a cylinder head cover.

Figure 1:
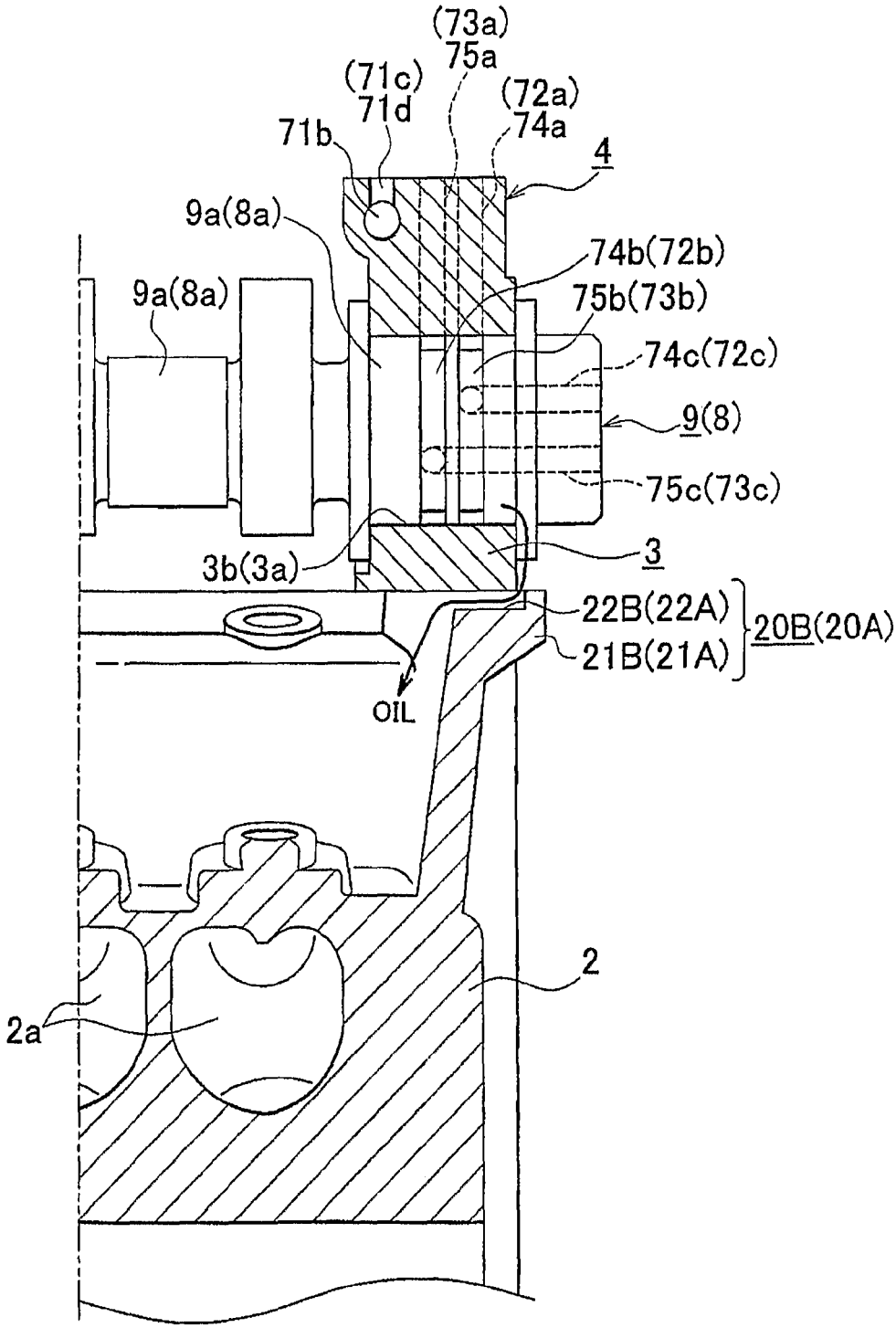
FIG. 1 is an arrow view of a cross section taken along the line I-I of FIG. 6, wherein an engine according to a first embodiment of the invention is shown.

The cylinder head 2 is mounted with, although not shown, an intake valve for opening and closing an intake port and an exhaust valve for opening and closing an exhaust port 2*a* (only shown in FIG. 1). The cam housing 3 is mounted with an intake camshaft 8 for opening and closing the intake valve and an exhaust camshaft 9 for opening and closing the exhaust valve.

A pair of the camshafts 8, 9 are mounted on a plurality of pairs of concave bearings 3*a*, 3*b* provided in a plurality of sections of the cam housing 3 in a front-back direction thereof, and the cam cap 4 is fastened by bolts 15A to the top of each pair of concave bearings 3*a*, 3*b* arranged in a width direction of the engine, whereby axial and radial positions of each of the camshafts 8, 9 are determined.

Figure 2:
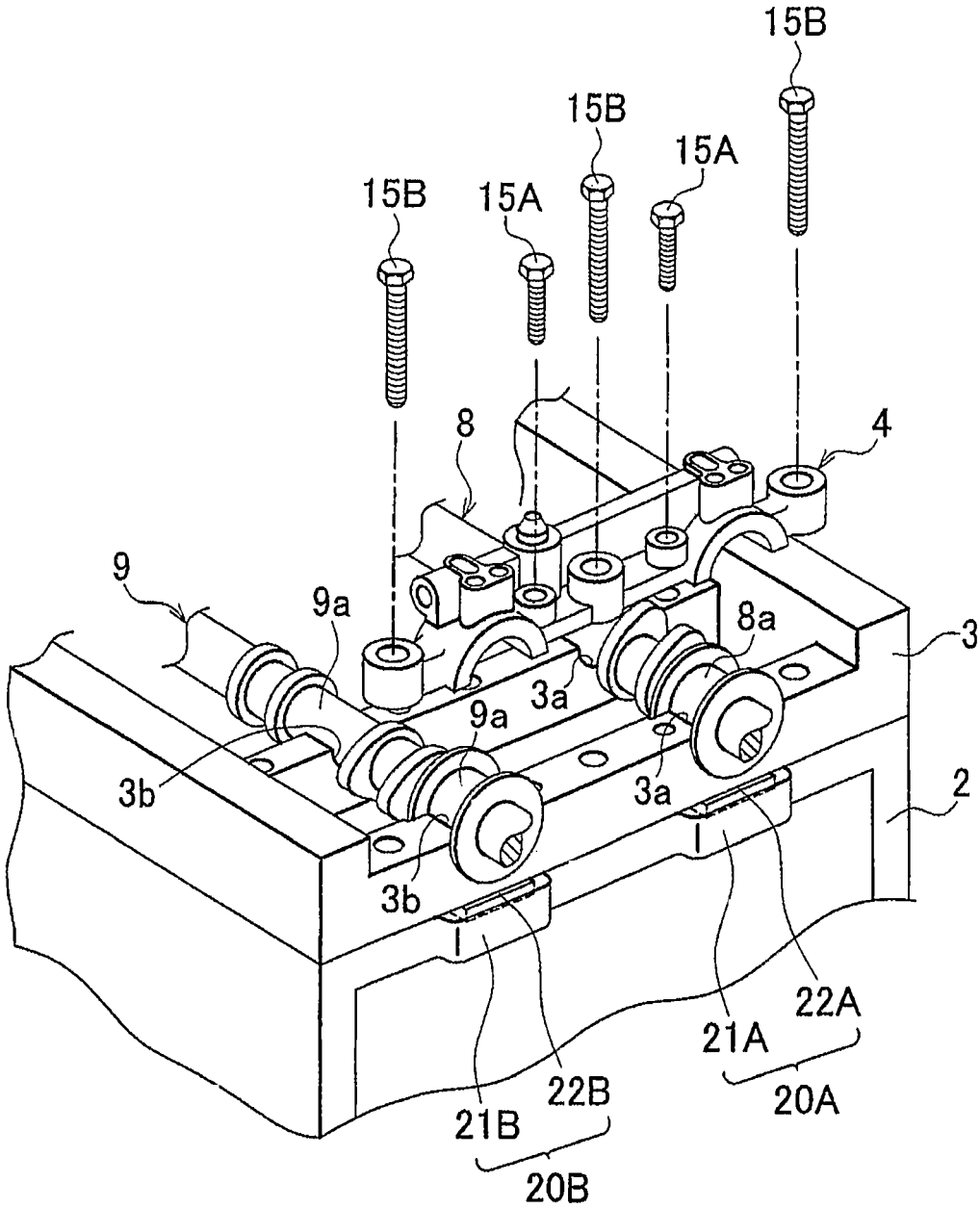
FIG. 2 is a perspective view showing the front of a state in which a cam cap of FIG. 1 is separated.
Figure 3:
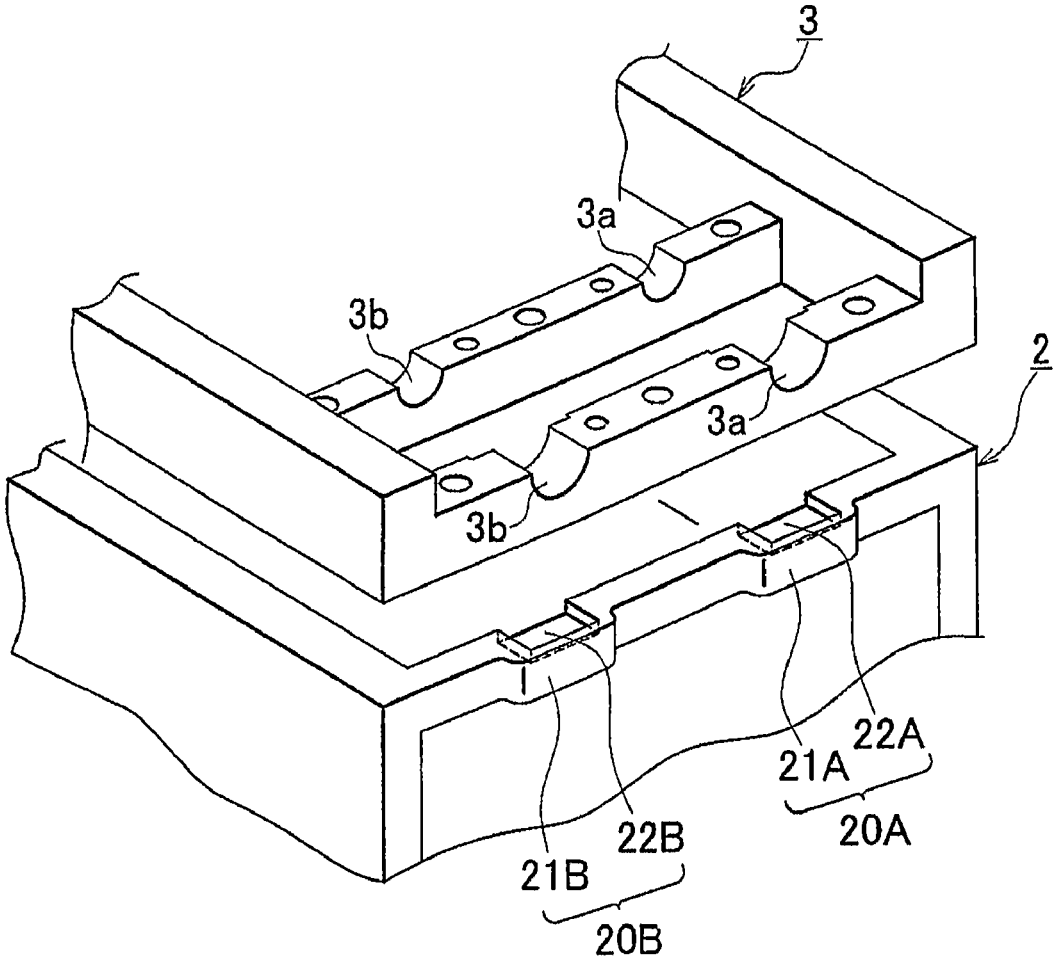
FIG. 3 is a perspective view showing a state in which a cylinder head and cam housing shown in FIG. 2 are separated.

Note that the cam cap 4 is fastened to the cam housing 3 by two short bolts 15A as shown in FIG. 2, and the cam cap 4 and the cam housing 3 are fastened to the cylinder head 2 by three long bolts 15B.

The sections in the camshafts 8, 9 that are supported by the concave bearings 3*a*, 3*b* and the cam cap 4 are called "journal parts 8*a*, 9*a*," respectively.

Note that the abovementioned intake valve, exhaust valve, intake camshaft 8 and exhaust camshaft 9 are generically called "valve mechanism." This valve mechanism is covered from the outside by the cylinder head cover 7 attached to an upper part of the cylinder head 3. Although depending on the type of the engine, this valve mechanism also includes a lock arm and lash adjuster.

The intake camshaft 8 and the exhaust camshaft 9 are driven to rotate by a crankshaft 11 via the timing chain 5.

The timing chain 5 is wound around a timing gear 12 provided on one end of the intake camshaft 8 in an axial direction thereof, a timing gear 13 provided on one end of the exhaust camshaft 9 in an axial direction thereof, and a timing gear 14 provided on one end of the crankshaft 11 in an axial direction thereof.

The timing chain 5 and the three timing gears 12 to 14 configure a power transmission system for transmitting torque from the crankshaft 11 to each of the camshafts 8, 9. This power transmission system is generally disposed on an external side of a front wall of the cylinder block 1, the cylinder head 2 and cam housing 3, and is covered and protected by the timing chain cover 6 attached to the front wall of the cylinder block 1, the cylinder head 2 and cam housing 3.

Here, the engine is designed such that oil contained in an oil pan 16 can be repeated circulated and used within the engine.

Specifically, the oil that is contained in the oil pan 16 provided on a bottom part of the cylinder block 1 is pumped up by an oil pump driven by the crankshaft 11, filtered through a filter, and then supplied to the cylinder block 1 side and the cylinder head 2 side.

The oil supplied to the cylinder block 1 side is returned to the oil pan 16 after being used for lubricating a crankshaft journal part and the inside of a cylinder by means of an oil jet. The oil supplied to the cylinder head 2, on the other hand, is returned to the oil pan 16 after being used for lubricating each of the components configuring the valve mechanism.

Incidentally, the engine described above is equipped with a variable valve timing (VVT) mechanism.

This variable valve timing mechanism is capable of adjusting the valve timing (opening and closing) of the intake valve and exhaust valve by continuously changing phases of the intake camshaft 8 and of the exhaust camshaft 9.

Figure 7:
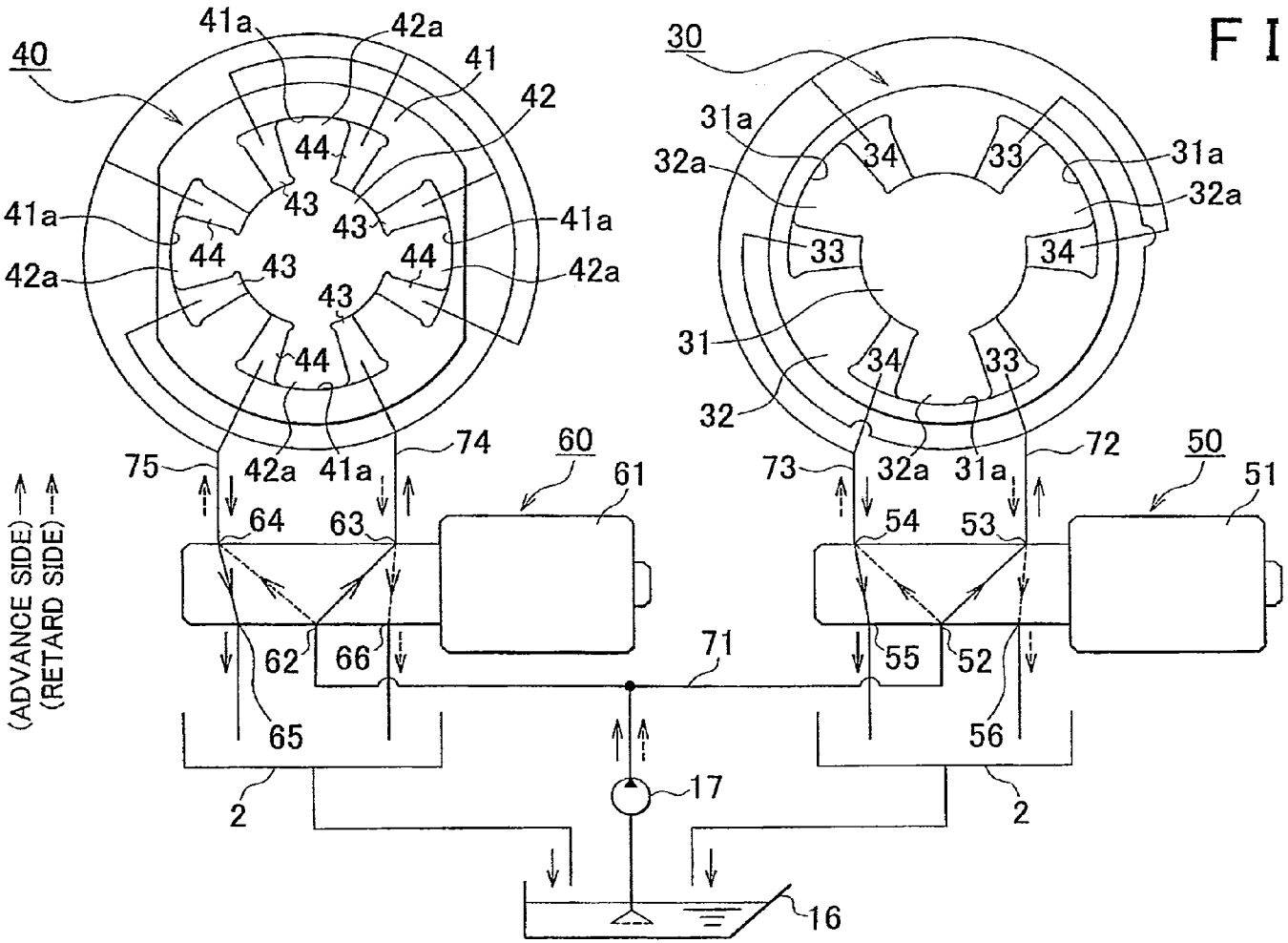
FIG. 7 is a view schematically showing hydraulic paths of intake and exhaust variable valve timing mechanisms mounted in the engine shown in FIG. 4.

This variable valve timing mechanism is of hydraulically-driven type. This variable valve timing mechanism is configured by VVT controllers 30, 40 and a control system (including oil control valves 50, 60, an electronic control device etc., not shown), as shown in FIG. 7.

The VVT controllers 30, 40, called "vane actuators" of conventional type, are configured mainly by outer rotors 31, 41 and vane rotors 32, 42.

Figure 5:
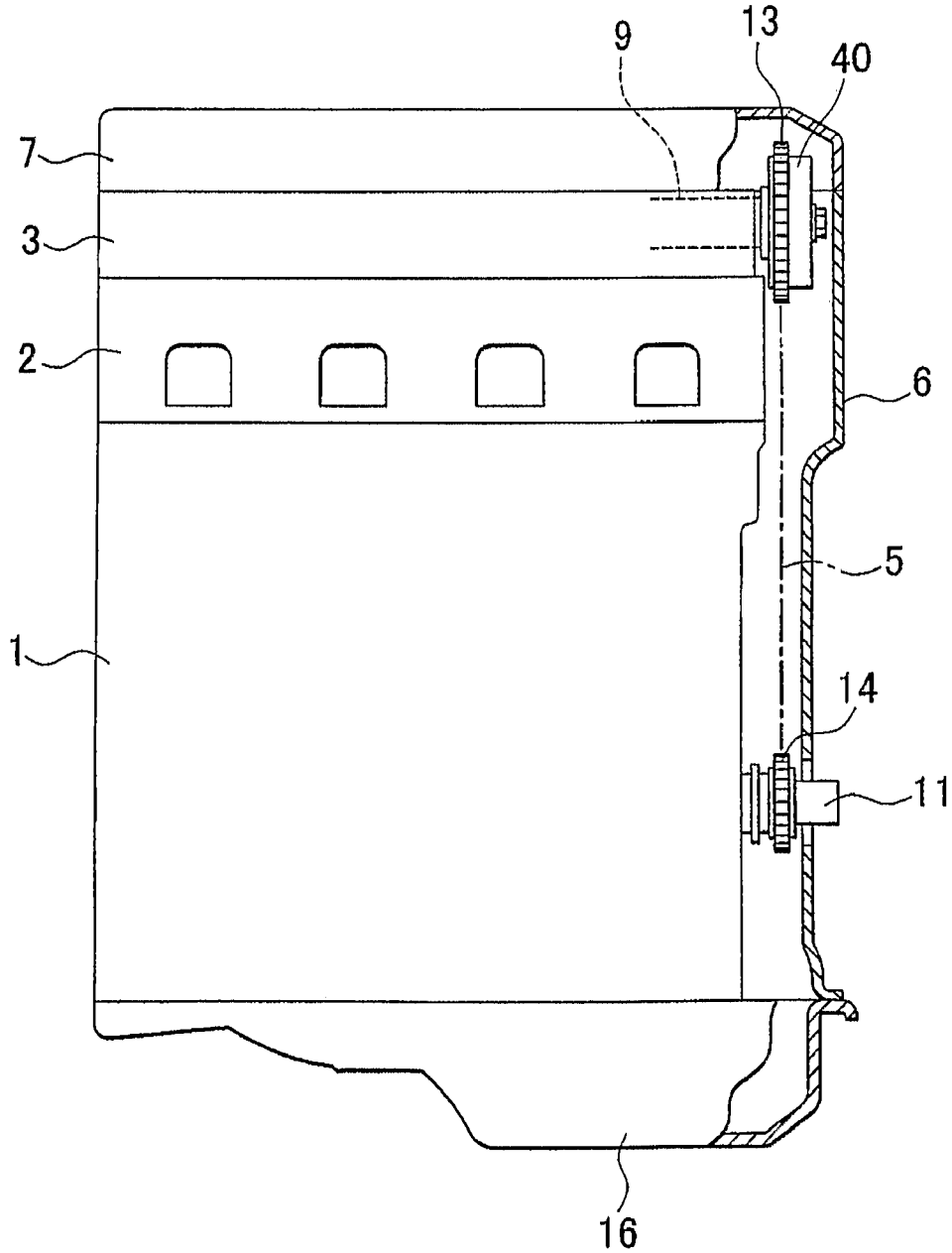
FIG. 5 is a side view showing a fractured front end side of the engine of FIG. 4.
Figure 6:
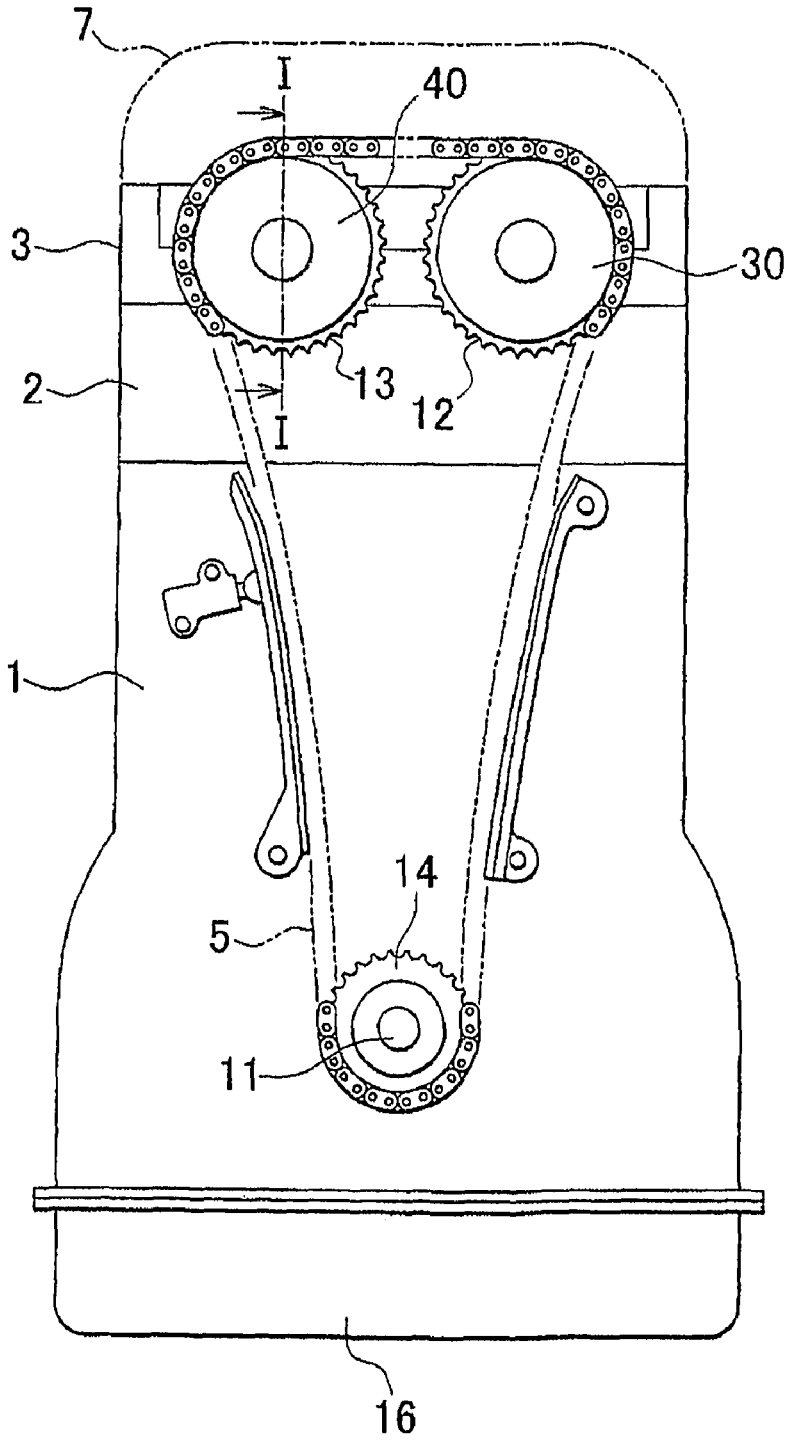
FIG. 6 is a front view showing a state in which a timing chain cover is removed from the engine shown in FIG. 5.

The VVT controllers 30, 40 are annexed, respectively, to front ends of the camshafts 8, 9 so as to be disposed on an external side of a front wall of the cylinder block 1, and covered and protected by the timing chain cover 6 as shown in FIG. 5, as with the power transmission system described above.

The timing gears 12, 13 that are provided respectively on the ends of the intake camshaft 8 and exhaust camshaft 9 in the axial directions thereof are integrally provided on outer diameters of the outer rotors 31, 41, respectively. Specifically, the outer rotors 31, 41 are driven by the crankshaft 11.

The vane rotors 32, 42 are attached, respectively, to the front ends of the intake camshaft 8 and exhaust camshaft 9 so as to be rotatable, and accommodated, respectively, in the outer rotors 31, 41 so as to be able to swing relative to each other in a circumferential direction.

Several sections on an inner periphery of each of the outer rotors 31, 41 are provided with concave parts 31*a*, 41*a* that are recessed radially outward, and several sections on an outer periphery of each of the vane rotors 32, 42 are provided with vanes 32*a*, 42*a* that protrude radially outward (the same number as the number of concave parts 31*a*, 41*a*).

Each vane 32*a*, 42*a* of the vane rotor 32, 42 is inserted into the corresponding concave part 31*a*, 41*a* of the outer rotor 31, 41 so as to be able to swing in the circumferential direction, and an advance-side pressure chamber 33, 43 and retard-side pressure chamber 34, 44 are secured on each side of each vane 32*a*, 42*a* in the circumferential direction in each concave part 31*a*, 41*a*.

Note that the number of concave parts 31*a* of the intake outer rotor 31 and the number of vanes 32*a* of the intake vane rotor 32 are both three, while the number of concave parts 41*a* of the exhaust outer rotor 41 and the number of vanes 42*a* of the exhaust vane rotor 42 are both four as shown in FIG. 7. Therefore, three advance-side pressure chambers 33 and three retard-side pressure chambers 34, i.e., a total of six pressure chambers, are provided in the intake controller 30, while four advance-side pressure chambers 43 and four retard-side pressure chambers 44, i.e., a total of eight pressure chambers, are provided in the exhaust controller 40.

The oil control valves 50, 60 adjust the amount of working oil to be supplied to the advance-side pressure chambers 33, 43 or retard-side pressure chambers 34, 44 and the amount of working oil to be returned from the advance-side pressure chambers 33, 43 or retard-side pressure chambers 34, 44. Although the oil control valves 50, 60 are not illustrated in detail, the oil control valves 50, 60 are of conventional electromagnetically-driven spool type.

Specifically, electromagnetic solenoids 51, 61 of the respective oil control valves 50, 60 are controlled by an electronic control device (ECU), which is not shown, to displace an axial direction of spool valves (not shown) and open/close five ports 52 to 56, 62 to 66. Accordingly, the amount of working oil to be supplied to each of the pressure chambers 33, 43, 34, 44 and the amount of working oil to be returned to each of the pressure chambers 33, 43, 34, 44 are adjusted to drive the intake camshaft 13 or the exhaust camshaft 14 to the advance side or retard side.

Basic operations of the variable valve timing mechanism are described.

When advancing a valve timing, the working oil is supplied from advance ports 53, 63 of the oil control valves 50, 60 to the advance-side pressure chambers 33, 43, respectively, as shown by the solid arrows in FIG. 7. In so doing, the working oil within the retard-side pressure chambers 34, 44 is returned to the oil control valves 50, 60.

Conversely, when retarding the valve timing, the working oil is supplied from retard ports 54, 64 of the oil control valves 50, 60 to the retard-side pressure chambers 34, 44, respectively, as shown by the dashed arrows in FIG. 7. In so doing, the working oil within the retard-side pressure chambers 33, 43 is returned to the oil control valves 50, 60.

The working oil that is returned to the oil control valves 50, 60 is normally discharged from drain ports 55, 56, 65, 66 into an internal space surrounded by the cam housing 3 and the cylinder head cover 7.

Incidentally, the working oil used in the variable valve timing mechanism is oil that is supplied from the abovementioned oil pan 16 to the cylinder head 2 side. This passage for distributing the working oil is described simply hereinafter with reference to FIGS. 7 to 9.

The abovementioned distribution passage is configured by, as shown in FIG. 7, a conveyance passage 71 that connects the oil control valves 50, 60 to an upper end of a supply passage (not shown) for guiding oil pumped up by an oil pump 17 from the oil pan 16 to the cylinder head 2 side, advance-side oil passages 72, 74 that connect the oil control valves 50, 60 to the advance-side pressure chambers 33, 43 of the VVT controllers 30, 40, respectively, and retard-side oil passages 73, 75 that connect the oil control valves 50, 60 to the retard-side pressure chambers 34, 44 of the VVT controllers 30, 40, respectively.

Figure 8:
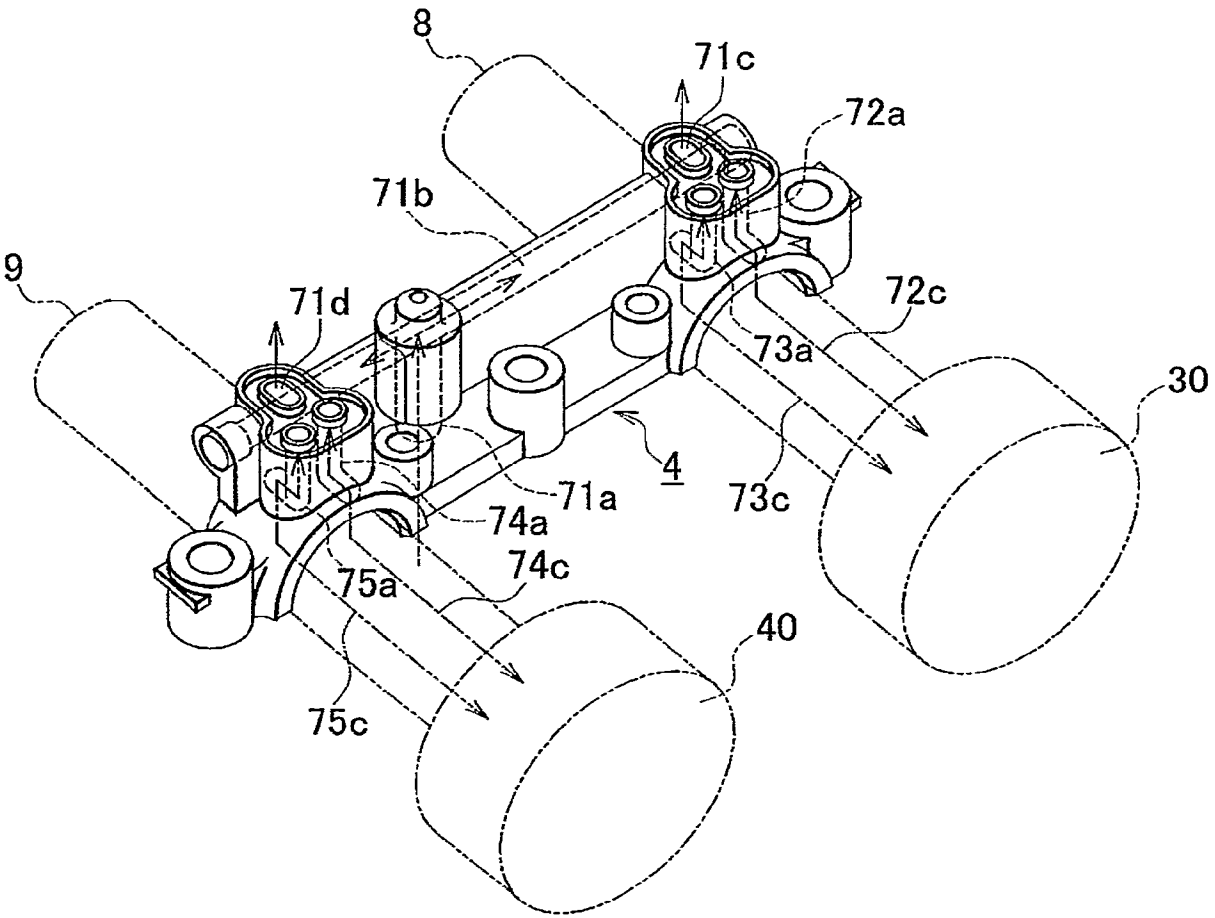
FIG. 8 is a perspective view showing forefront ends of the cam cap of the engine shown in FIG. 4.
Figure 9:
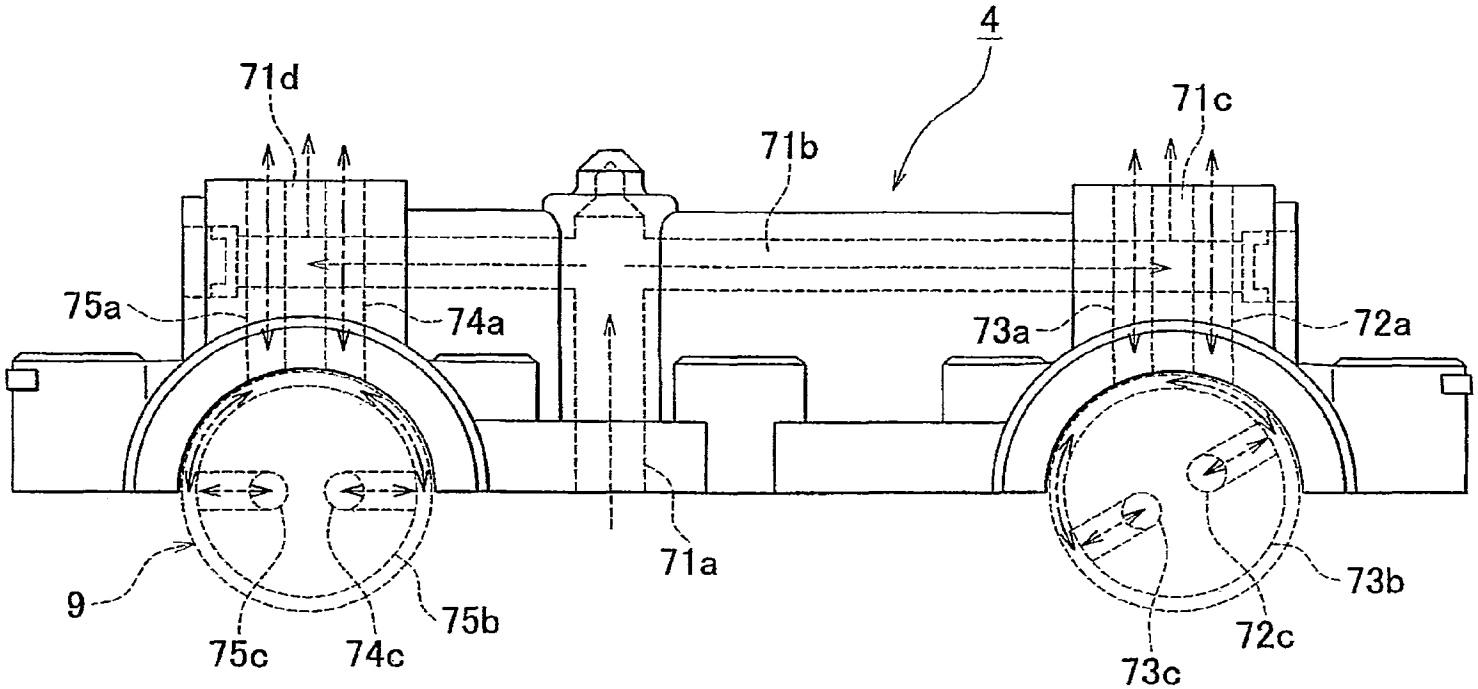
FIG. 9 is a view showing the front of the cam cap of FIG. 8.

The conveyance passage 71 shown in FIG. 7 is provided in the cam cap 4 as shown in FIGS. 8 and 9, and is configured by a combination of a cylindrical upstream part 71*a* disposed horizontally in the middle of the cam cap 4 in its longitudinal direction, a cylindrical intermediate part 71*b* disposed horizontally along the longitudinal direction of the cam cap 4, and cylindrical downstream parts 71*c*, 71*d* that are opened upward at both ends of the intermediate part 71*b*.

Note that the intermediate part 71*b* is in the form of a horizontally disposed cylinder that is closed by mounting lids on its holes that are penetrated from its both ends through the longitudinal direction of the cam cap 4.

The advance-side oil passages 72, 74 and the retard-side oil passages 73, 75 shown in FIG. 7 is configured by, as shown in FIGS. 8 and 9, a combination of parts provided in the cam cap 4 (vertically cylindrical through-holes 72*a*, 73*a*, 74*a*, 75*a*), parts provided in the intake camshaft 8 and exhaust camshaft 9 (outer peripheral grooves 72*b*, 73*b*, 74*b*, 75*b* shown only in FIG. 1 and L-shaped holes 72*c*, 73*c*, 74*c*, 75*c*), and parts provided in the vane rotors 32, 42 (holes not shown).

Note that the outer peripheral grooves 72*b*, 73*b*, 74*b*, 75*b* are provided at the positions matching with lower end openings of the through-holes 72*a*, 73*a*, 74*a*, 75*a* of the cam cap 4, and radial direction parts of the L-shaped holes 72*c*, 73*c*, 74*c*, 75*c* are opened circumferentially at predetermined positions of the bottom of the outer peripheral grooves 72*b*, 73*b*, 74*b*, 75*b*.

Therefore, even when the camshafts 8, 9 is rotated, the through-holes 72*a*, 73*a*, 74*a*, 75*a* of the non-rotated cam cap 4 are always communicated coupled respectively with the L-shaped holes 72*c*, 73*c*, 74*c*, 75*c* of the camshafts 8, 9. Each of the L-shaped holes 72*c*, 73*c*, 74*c*, 75*c* can be obtained by, for example, perforating it with a drill in the axial direction and radial direction.

The sections applied with the characteristics of this embodiment are now described in detail.

Specifically, this embodiment is constituted such that leakage of the oil into the internal space of the timing chain cover 6 is inhibited or avoided by guiding the oil to the inner side of the peripheral wall of the cylinder head 2, the oil leaking from the sliding contact surface where each of the forefront-end journal parts 8*a*, 9*a* of the corresponding camshaft 8, 9 comes into sliding contact with each of the forefront-end concave bearings 3*a*, 3*b* of the cam housing 3 and with the cam cap 4.

More specifically, at the front wall upper end of the cylinder head 2, oil recovery parts 20A, 20B are provided in the regions corresponding to the two forefront-end concave bearings 3*a*, 3*b* of the cam housing 3.

These oil recovery parts 20A, 20B are configured, respectively, by projecting parts 21A, 21B provided at the front wall upper end of the cylinder head 2 and grooves 22A, 22B provided in the projecting parts 21A, 21B.

The projecting parts 21A, 2113 are provided only on, for example, the front wall upper end side of the cylinder head 2, and thus the entire front wall of the cylinder head 2 does not project. Therefore, the projecting parts 21A, 21B are beneficial in preventing the increase in the weight of this front wall as much as possible.

Moreover, the grooves 22A, 22B are each provided in an area between the part that is inside and not far from the projecting edge of each of the projecting parts 21A, 21B and the inner surface side of the peripheral wall of the cylinder head 2. This means that a rising wall exists on the front end side of each groove 22A, 22B and the rear end side of the groove 22A, 22B (inner surface side of the peripheral wall) is opened inward of the cylinder head 2. For this reason, the oil leaking from the sliding contact surface can easily enter the grooves 22A, 22B and is prevented from falling outside the peripheral wall of the cylinder head 2 once entering the grooves 22A, 22B.

The upward opening of each of the grooves 22A, 22B is covered by a lower surface of each of the concave bearings 3*a*, 3*b* provided at the forefront end of the cam housing 3, but a front part of the upward opening of each of the grooves 22A, 22B is opened outward.

As described above, the first embodiment is constituted such that when the oil leaks from the sliding contact surface where each of the forefront-end journal part 8*a*, 9*a* of the corresponding camshaft 8, 9 comes into sliding contact with each of the forefront-end concave bearings 3*a*, 3*b* of the cam housing 3 and with the cam cap 4, this leaking oil is caused to drop into each of the grooves 22A, 22B of the corresponding oil recovery parts 20A, 20B and guided from the groove 22A, 22B to the inner side of the peripheral wall of the cylinder head 2.

Therefore, because the oil can be drawn to the inner side of the peripheral wall of the cylinder head 2 even when it leaks from the sliding contact surface, leakage of the oil into the internal space of the timing chain cover 6 that occurs in the related art can be inhibited or avoided. Therefore, the phenomenon in which excessive amount of oil is supplied to the timing chain 5 as in the related art can be inhibited or prevented as well as unexpected grow of friction loss that occurs in, for example, the related art.

Note that this invention is not limited to the above embodiment, and thus all types of modifications or applications are possible within the scope of the claims and the scope equivalent to this scope. Followings are the examples of such modifications or applications.

(1) The engine according to this invention is not limited to in-line engines or V-type engines, and the number of cylinders is also not particularly limited. Therefore, the engine of this invention may be a gasoline engine or a diesel engine.

(2) The embodiment above has described an example in which the variable valve timing mechanism is annexed to each of the intake camshaft 8 and the exhaust camshaft 9, but this invention can be applied to an engine in which the variable valve timing mechanism is mounted in either the intake camshaft 8 or the exhaust camshaft 9. Moreover, the oil recovery structure of this invention can be applied to an engine that is not provided with the variable valve timing mechanism.

Figure 10:
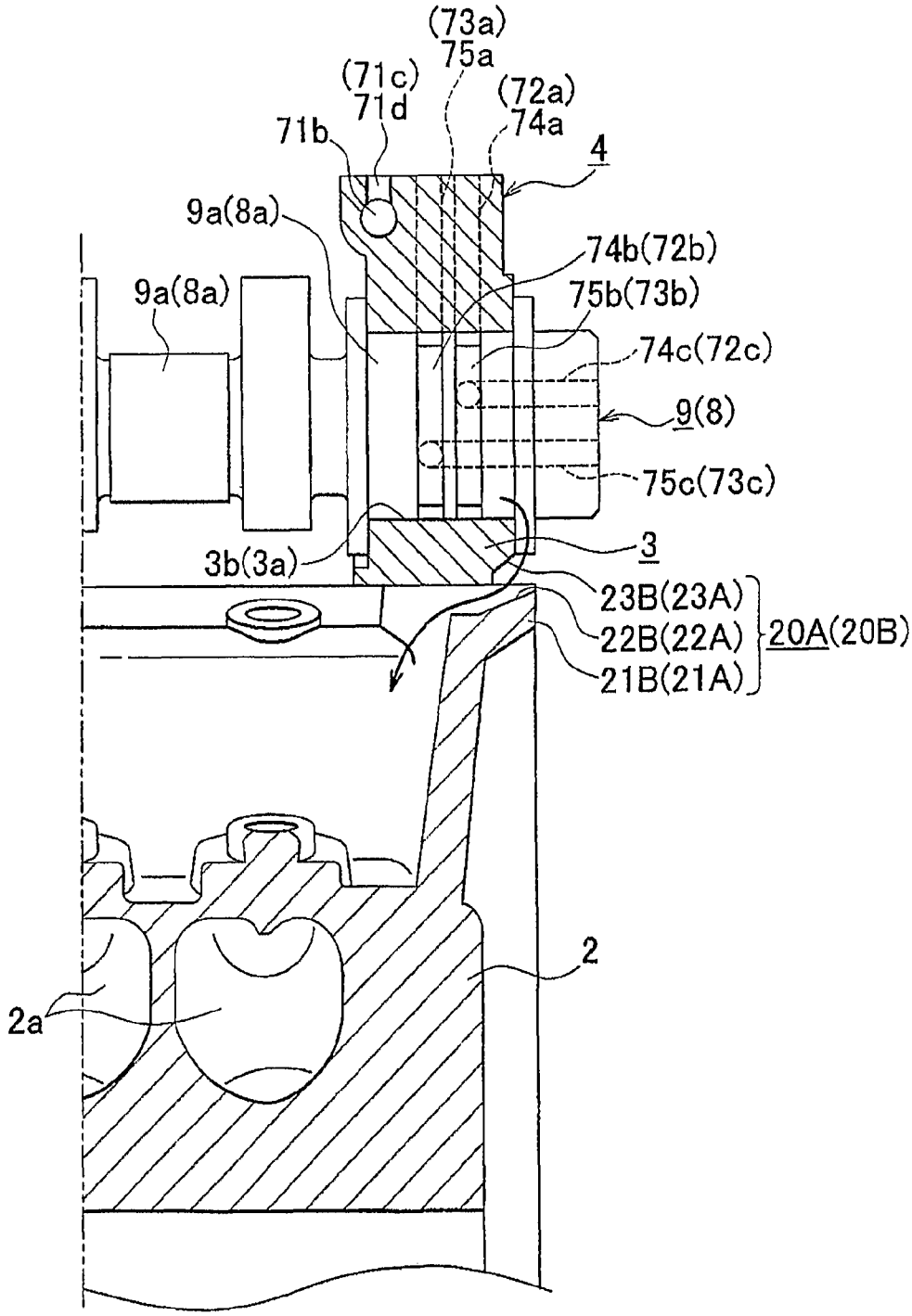
FIG. 10 is a view showing an engine according to a second embodiment of the invention, the view corresponding to FIG. 1.
Figure 11:
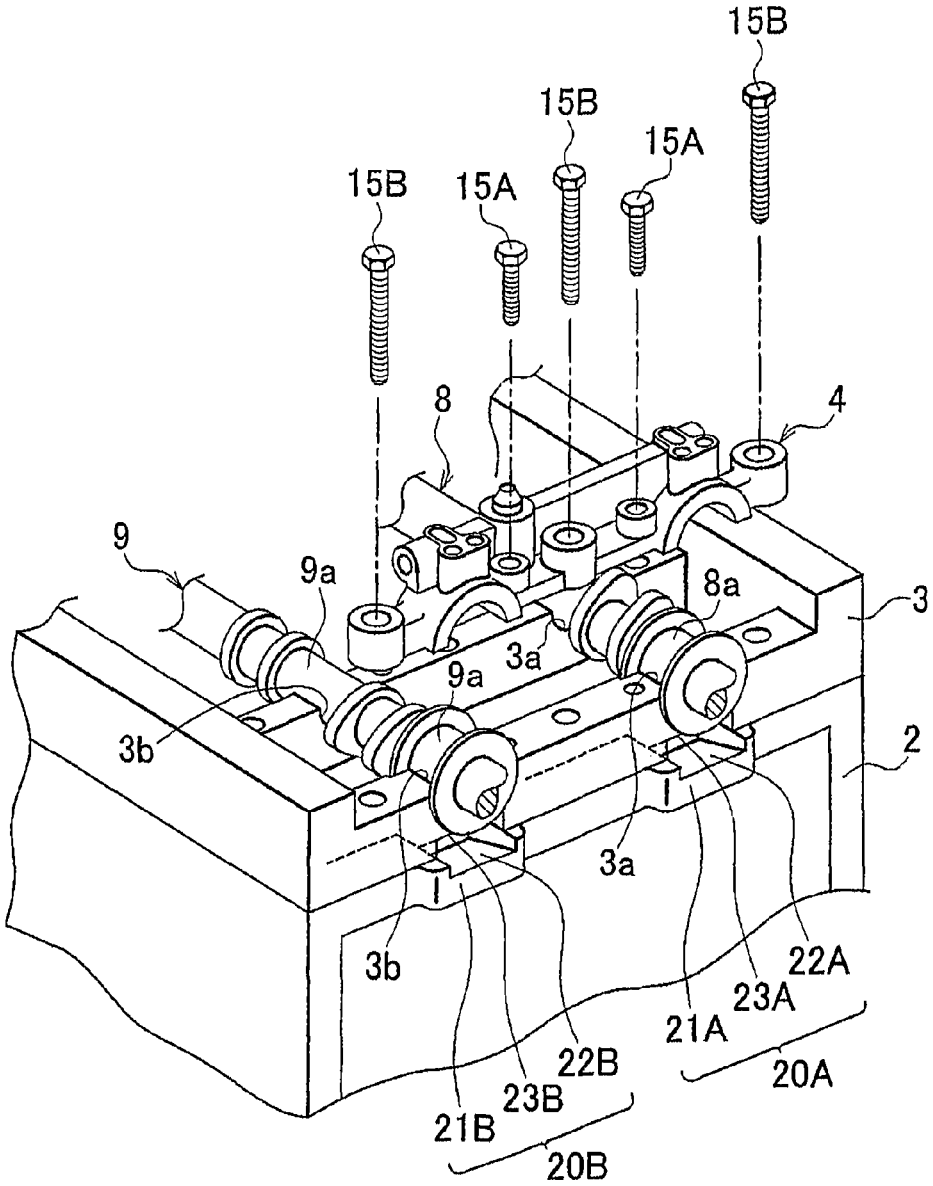
FIG. 11 is a view of the second embodiment corresponding to FIG. 2.
Figure 12:
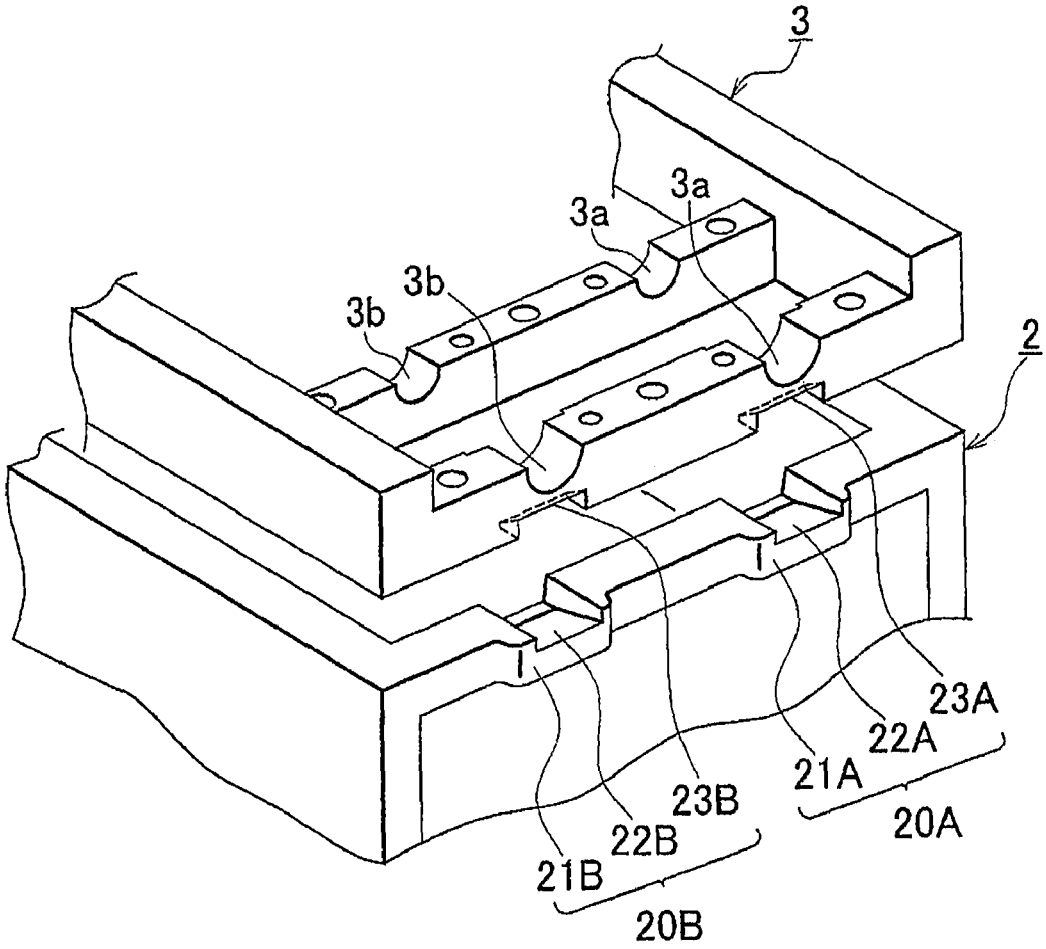
FIG. 12 is a view of the second embodiment corresponding to FIG. 3.

(3) A second embodiment of this invention is described in detail with reference to FIGS. 10 to 12.

The second embodiment also has oil recovery parts 20A, 20B that basically play the same roles as the oil recovery parts 20A, 20B of the first embodiment, but the structures of the oil recovery parts 20A, 20B of the second embodiment are different from those of the first embodiment.

Each of the oil recovery parts 20A, 20B is configured by a projecting parts 21A, 21B provided at a front wall upper end of a cylinder head 2, a groove 22A, 22B provided in the projecting part 21A, 21B, and a tapered slope 23A, 23B provided at a front end lower corner of a concave bearing 3*a*, 3*b* provided at a forefront end of a cam housing 3.

Each of the grooves 22A, 22B is provided over the area between a leading end of each of the projecting parts 21A, 21B and a front wall of the cylinder head 2, that is, along the entire length of the front wall of the cylinder head 2 in its front-back direction.

However, in this embodiment, only a front-half region of an upward opening of the groove 22A, 22B is formed into a descending tapered slope; while a rear-half region is formed into a flat surface. In this manner, when oil enters the groove 22A, 22B the oil can be caused to flow easily toward the inner side of the peripheral wall of the cylinder head 2 but not to flow out of the peripheral wall of the cylinder head 2. Note that each of the grooves 22A, 22*b* may be entirely inclined downward from a leading end of the peripheral wall of the cylinder head 2 toward the inside of the cylinder head 2.

Also, by providing the abovementioned slopes 23A, 23B in the cam housing 3, a lower end of an external surface of a front wall of the cam housing 3 can be recessed deeper than an upper end of the external surface of the front wall of the cylinder head 2.

In this case, the upward opening of each of the grooves 22A, 22B is covered by a lower surface of each of the concave bearings 3*a*, 3*b* provided at the forefront end of the cam housing 3, but the front end side of the upward opening of the groove 22A, 22B is opened wide outward of the peripheral wall of the cylinder head 2 due to the presence of each of the slopes 23A, 23B.

Therefore, by providing a large gap between each of the slopes 23A, 23B and each of the grooves 22A, 22B, the oil leaking from the forefront-end concave bearing 3*a* of the cam housing 3 can be received easily.

In this embodiment as well, operations and effects that are basically the same as those of the first embodiment can be obtained. Specifically, the oil, which leaks from the sliding contact surface where each of the forefront-end journal parts 8*a*, 9*a* of the corresponding camshaft 8, 9 comes into sliding contact with each of the forefront-end concave bearings 3*a*, 3*b* of the cam housing 3 and with the cam cap 4, is drawn from each of the oil recovery parts 20A, 20B toward the inner side of the peripheral wall of the cylinder head 2. Consequently, the phenomenon in which excessive amount of oil is supplied to the timing chain 5 as in the related art can be inhibited or prevented as well as unexpected grow of friction loss that occurs in the related art.

The second embodiment in which the slopes 23A, 23B are provided below at least the forefront-end concave bearings 3*a*, 3*b* at the external surface of the front wall of the cam housing 3 is more beneficial than the above-described embodiment, in view of achieving weight reduction.

While the invention has been described with reference to the example embodiments thereof, it is to be understood that the invention is not limited to the described embodiments or constructions. On the other hand, the invention is intended to cover various modifications and equivalent arrangements. In addition, while the various elements of the disclosed invention are shown in various example combinations and configurations, other combinations and configurations, including more, less or only a single element, are also within the scope of the appended claims.

The invention claimed is:

1. An engine in which a camshaft is supported rotatably by a cam housing mounted on a cylinder head, comprising:

an oil recovery part, provided at an upper end of the cylinder head on a side on which a timing chain is disposed, for guiding, to an inner side of a peripheral wall of the cylinder head, oil leaking from a camshaft-supporting concave bearing closest to the timing chain in the cam housing; and said oil recovery part comprises a projecting part formed on the peripheral wall of the cylinder head that protrudes from an outer side of the peripheral wall, and a groove formed on the projecting part, said groove having an upper face that faces a lower surface of the concave bearing.

2. The engine according to claim 1, wherein the projecting part has, at a front end thereof, a rising wall that extends upward toward the cam housing.

3. The engine according to claim 1, further comprising a tapered slope that is provided at a front end lower corner of the forefront-end concave bearing of the cam housing.

4. The engine according to claim 3, wherein an inclination of the tapered slope is formed such that a rear end thereof is positioned lower than a front end thereof

5. The engine according to claim 1, wherein the oil recovery part is provided below the concave bearing such that a front end of the projecting part is positioned forward of a forefront end of the concave bearing and a rear end of the groove is positioned on the inner side of the peripheral wall of the cylinder head.

6. The engine according to claim 1, wherein the projecting part protrudes from the outer side of the peripheral wall in a direction transverse to a surface of the outer side of the peripheral wall.

7. An engine, comprising:

a cylinder head;

a cam housing, separate from the cylinder head and mounted on the cylinder head;

an intake camshaft and exhaust camshaft that are supported rotatably by the cam housing;

a hydraulically-driven variable valve timing mechanism which has a controller constituted by a vane actuator installed at a front end of at least one of the intake camshaft and the exhaust camshaft, and an oil control valve for adjusting supply/recovery of working oil with respect to the controller, and which is capable of changing a timing of opening and closing at least one of an intake valve and an exhaust valve by advancing or retarding a rotational phase of at least one of the intake camshaft and exhaust camshaft in relation to a rotational phase of a crankshaft;

a forefront-end side journal part of the camshaft, which is provided with a part of an oil passage connecting the controller to the oil control valve;

a concave bearing provided at a forefront end of the cam housing which supports the camshaft; and an oil recovery part formed in a front wall upper end of the cylinder head on a side on which a timing chain is disposed, that guides, to an inner side of a peripheral wall of the cylinder head, oil leaking from a sliding contact surface between the forefront-end side journal part of the camshaft and the concave bearing closest to the timing chain in the cam housing, said oil recovery part comprising a projecting part protruding from an outer side of the peripheral wall, and a groove formed on the projecting part, said groove having an upper face that faces a lower surface of the concave bearing.

8. The engine according to claim 7, further comprising:

a conveyance passage for supplying the oil, which is pumped up from an oil pan by an oil pump, to the oil control valve; and an advance-side oil passage and a retard-side oil passage for exchanging the oil between the oil control valve and advance-side and retard-side pressure chambers of the controller, wherein the advance-side oil passage and the retard-side oil passage are each configured by at least combining a first part that is provided over an area between the oil control valve and an outer peripheral surface of the forefront-end journal part of the camshaft, and a second part that is connected from the first part to each of the pressure chambers through the inside of the camshaft.

9. The engine according to claim 7, wherein the projecting part protrudes from the outer side of the peripheral wall in a direction transverse to a surface of the outer side of the peripheral wall.

* * * * *